US005857202A

United States Patent [19]

Demoly et al.

[11] Patent Number: 5,857,202

[45] Date of Patent: Jan. 5, 1999

[54] COMPARING PROJECTILE SHELLS

[75] Inventors: Franck Demoly; Denis Perraud, both of Lyons, France

[73] Assignee: Ministerie de L'Interieur - Direction de la Police Judicaire Sous-Direction de la Police Technique et Scientifique Service Central des Laboratoires, Ecully Cedex, France

[21] Appl. No.: 781,147

[22] Filed: Jan. 9, 1997

[30] Foreign Application Priority Data

Jan. 9, 1996 [FR] France ..... 96 00173

[51] Int. Cl.[6] ..... G06F 17/30

[52] U.S. Cl. ..... 707/104; 382/108; 382/278; 356/388

[58] Field of Search ..... 707/104; 382/108, 382/278; 356/388

[56] References Cited

U.S. PATENT DOCUMENTS

| | | | |
|---|---|---|---|
| 3,680,966 | 8/1972 | Cofek et al. . | |
| 4,596,037 | 6/1986 | Bouchard et al. . | |
| 4,644,583 | 2/1987 | Watanabe et al. . | |
| 5,134,661 | 7/1992 | Reinsch . | |
| 5,179,642 | 1/1993 | Komatsu | 345/435 |
| 5,390,108 | 2/1995 | Baldur et al. | 702/167 |
| 5,659,489 | 8/1997 | Baldur | 382/108 |
| 5,680,484 | 10/1997 | Ohyama et al. | 382/255 |

OTHER PUBLICATIONS

G.D. Arndt, "Ballistic Signature Identification Studies" 1 Jan. 1977 Proceedings of the Carnahan conference on crime counter–measure, Apr. 6–8, 1977, Kentucky, USA, p. 235, Abstract.

G.Y. Gardner. Computer identification of bullets:, 1 Jan. 1977 Proceedings of the Carnahan Conference on Crime Countermeasures, Kentucky, USA, Apr. 6–8, pp. 149–166.

G.D. Arndt. "Bullet signature identification . . . " 1 Jan. 1983 Proceedings International Carnahan Conference on Security Technology, pp. 145–151.

*Primary Examiner*—Paul R. Lintz

*Attorney, Agent, or Firm*—Nixon & Vanderhye

[57] ABSTRACT

Digital data, each piece of data corresponding to a different criterion associated with an impression on a projectile, is stored in a database. A number of images of a target projectile are processed to extract the data, where each datum corresponds to one of a different criterion. The different criteria include such features as shape, position, texture, and striation, center and shape of the percussion zone, caliber of the projectile, impressions of the stop, ejector, loading indicator, and feed mechanism et alia. The data from the target projectile is then compared to the data from the reference projectile for a possible match.

21 Claims, 7 Drawing Sheets

COMPARING PROJECTILE SHELLS

This invention relates to a process for comparing projectiles and the device.

A process and projectile analysis device are known from applications PCT WO 93/22617 and WO 92/20988. However, the process taught by these patents requires the projectile to be illuminated by a planar beam along an intersecting plane, relative to the axis of symmetry of the projectile, to generate an illumination band transverse to the projectiles. This process requires that images of sections of projectiles be recorded, and then that these images of the different sections of the projectiles be assembled to reconstitute the projectile integrally. For this, it is necessary in a first step to detect, in the image of each section, the portions of the sections that are superimposed with the preceding image, to eliminate these parts.

Moreover, this device consequently requires means making it possible to modify the position of projectiles to be able to bring them into a position where the corresponding images of each projectile are mutually comparable. This thus requires significant storage means to store all the images and, on the other hand, calculation means that are not negligible, to arrive at making a comparison. This process and device are not applicable to projectile shells. Even if it were transferrable to projectile shells, this search method is limited to a single comparative criterion relating to scratches and does not make it possible to take other criteria into account.

The first object of the invention is to propose a process for comparing shells, making it possible to take various criteria into account and requiring less storage means for a number of superior criteria.

This first object is achieved because the process comprises:

A step of constituting and storing different existing projectiles in a memory of a database, containing, for each referenced projectile, a large amount of digital data, each piece of data corresponding to a different criterion associated with an impression on the projectile.

A step of taking a determined number of images of a target projectile and processing these images by a data processing system to extract the digital data, each datum corresponding to one of the criteria of the database.

A step of processing and extracting the digital data comprising a step of selection on a display means by interactive means from an image zone displayed on the display means and including the impression corresponding to a criterion, conversion of the selected zone of the image into a digitized representation of the image, then processing the digitized representation to extract the parameters that correspond to a given criterion.

A step of comparing each of the pieces of data of a target projectile with the data from each referenced projectile for the same criteria.

According to another particularity, the extraction and processing method varies as a function of the type of impression and of the associated criterion.

According to another particularity, each type of impression has a defined number of criteria selected from among the criteria of shape, position, texture, striation.

According to another particularity, when the type of impression is the percussion zone, the system calculates the center and the shape of the zone, then calculates an index that is the ratio of the selected zone to the surface of the impression.

According to another particularity, the user has means that make it possible to determine the criteria taken into account for the comparison, said means consisting of a list of criteria that can be displayed on the display means and by actions such as clicks that can be selected and validated by the user thanks to input means of the mouse type.

According to another particularity, the process makes a comparison according to the criterion of the caliber of the projectile shell.

According to another particularity, the process makes a comparison of the data on criteria corresponding to the impression of the stop.

According to another particularity, the process makes a comparison of the data on criteria corresponding to the impression lacking primer.

According to another particularity, the process makes a comparison of the data on criteria corresponding to the impression of the ejector.

According to another particularity, the process makes a comparison of the data on criteria corresponding to the impression of the extractor.

According to another particularity, the process makes a comparison of the data on criteria corresponding to the impression of the loading indicator.

According to another particularity, the process makes a comparison of the data on criteria corresponding to the impression of the mark of the feed mechanism.

According to another particularity, the process makes a comparison of the data on criteria corresponding to the impression of the passage of the extractor.

According to another particularity, the process makes a comparison of the data on criteria corresponding to the impression of the passage of the ejector.

According to another particularity, the process makes a comparison of the data on criteria corresponding to the percussion impression.

According to another particularity, the process makes a comparison of the data on criteria corresponding to the impression of primer striations and of the flat area left by the bolt mechanism during firing.

According to another particularity, the comparison of target data with the reference data according to the criterion of striations is made by counting the number of scratches on the target projectile located at the same spot as the scratches on the reference projectile, then by applying a filtering coefficient to the result if the ratio between the number of scratches in the reference file, having been the object of a count, and the total number of scratches in the reference file is greater than 0.6.

Another object of the invention is to propose a device for constituting a reference database.

This object is achieved because the device comprises a presentation table of the projectile specimen provided with glancing illumination parallel to the projectile support, a support holding a digital-type camera with a wide field in a direction perpendicular to the support plane of the camera having a resolution of 1280×1024 pixels;

A device for analyzing digital data representing the image acquired and making it possible to extract, for a given specimen, the digital value representative of each criterion associated with a different type of impression; of a scratch, Interactive means making it possible for the user to complete the other criteria making up data from the database such as information concerning the caliber, and the defects;

Means of storing these data on a physical carrier that can be transported or transferred.

According to another particularity, the interactive means comprise applications software that makes it possible to display, on a monitor, a window comprising a number of text zones, each corresponding to a criterion and intended to receive, and accept only, digital data with, for each text zone, the designation, next to the text zone, of the criterion involved.

Another object of the invention is to propose a use of the device.

This object is achieved in that the device is used to extract data concerning a target projectile and exploit these data in a data processing system provided with application software that makes it possible to select, in the database, the criteria of the target file and, in the database of the data processing system, the same criteria for the reference files, then to perform, on each criterion, an evaluation of identical data so as to determine a probability index.

According to another particularity, the reference database and the digital values of the criteria of the target file are stored on a transportable physical carrier.

Other particularities and advantages of this invention will appear more clearly from reading the following description made with reference to the accompanying drawings in which.

Figure 1:
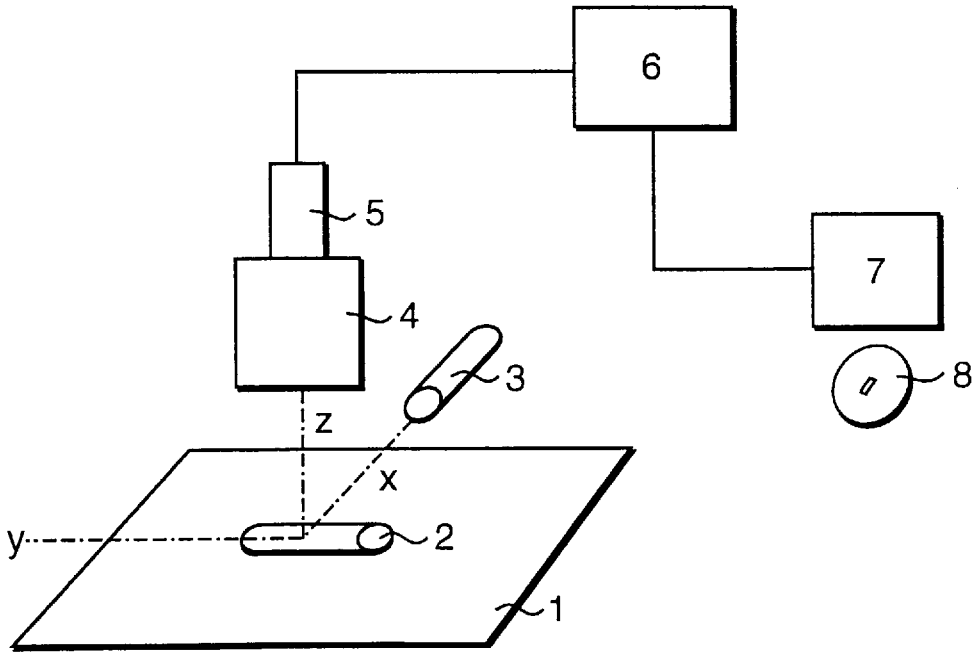
FIG. 1 represents a diagrammatic view of the device for constituting the database.

The device of FIG. 1 represents a support plate (1) on which projectile shell (2) is placed to be illuminated by a light beam coming from a light source (3). The light beam from this source (3) is glancing, so as to illuminate the upper edge of the surface of shell (2) in a direction perpendicular to axis y of the projectile and perpendicular to the plane formed by axis y of the projectile and to axis z of the optical observation means. The optical observation means consist of a binocular (4) or a microscope, for example of the type sold by the firm "LEITZ" under reference M420, coupled with an electronic camera (5), of the high-definition, digital, wide-field type, sold, for example, by the "VIDEK" company under the designation "Megaplus 1.4." This unit delivers a digitized signal processed by a data processing system (6), then sends the processing result to a storage means (7). This storage means (7), providing a transportable or transferable carrier (8) on which a database constituting all the reference files is recorded. This carrier (8) can be of the diskette, CD-ROM, digital magnetic cassette type. The device is also used then to provide corresponding data to a target object to transfer these data to an exploitation system to compare them with data from the database.

Figure 2:
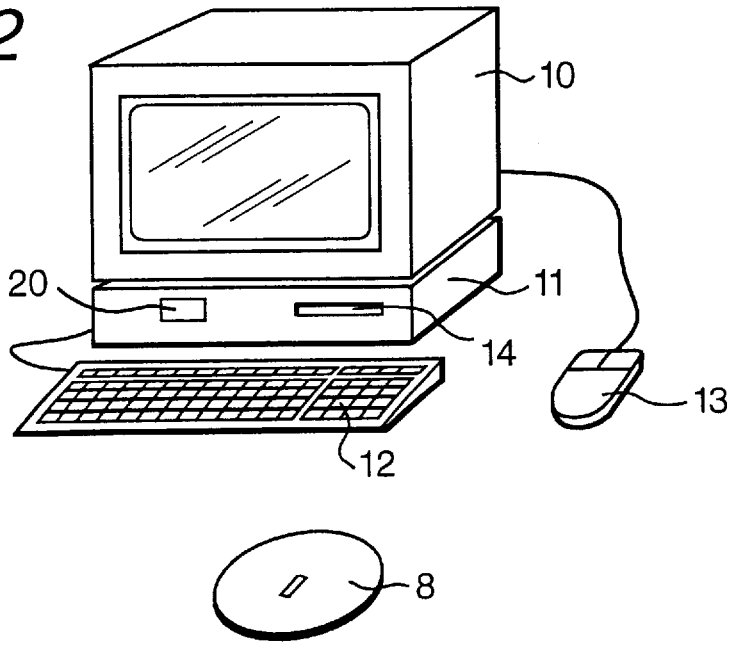
FIG. 2 represents a diagrammatic view of the exploitation data processing system.
Figure 3A:
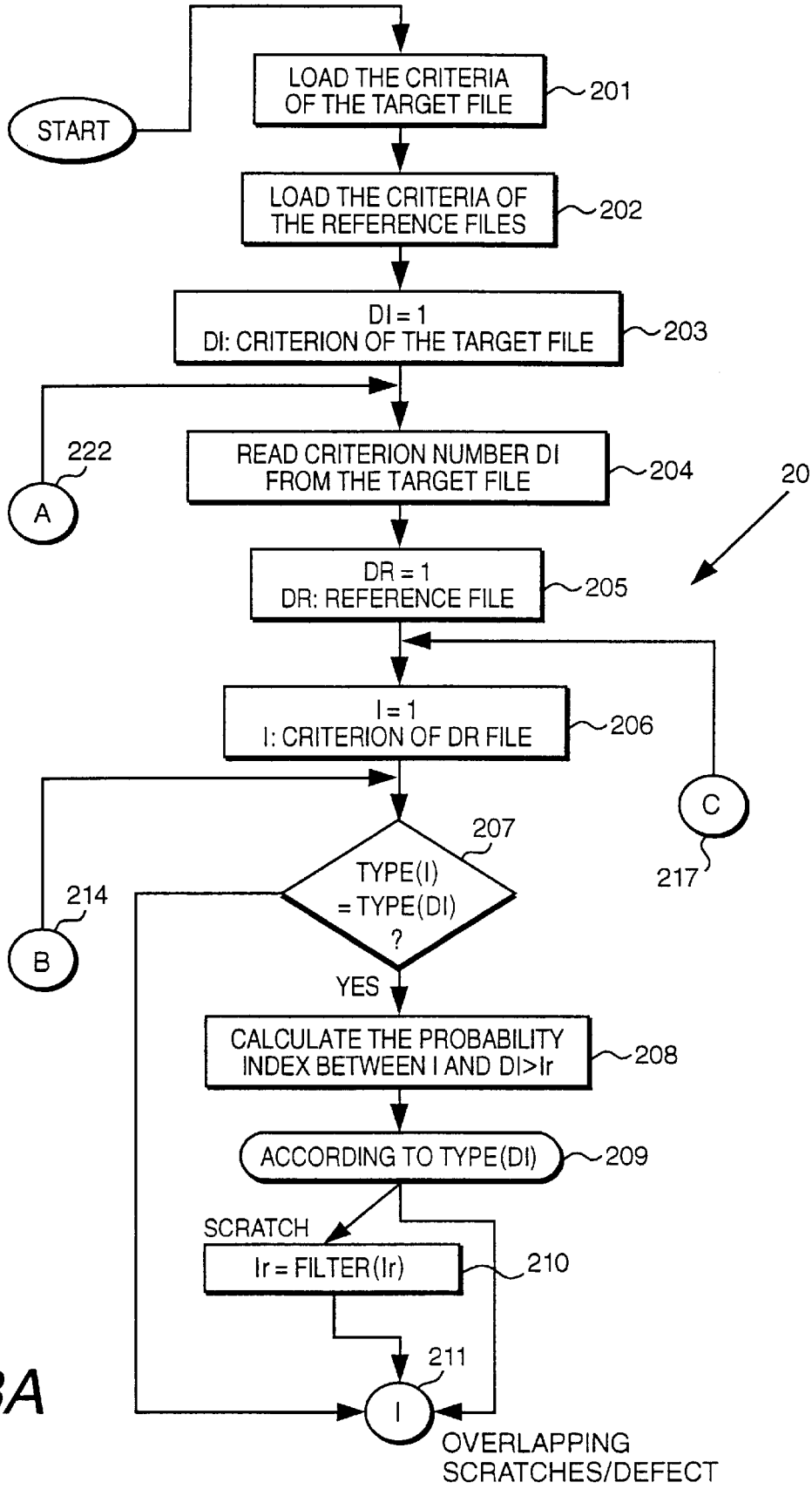
FIGS. 3A and 3B are the logic diagram of the operation of the exploitation system.
Figure 3B:
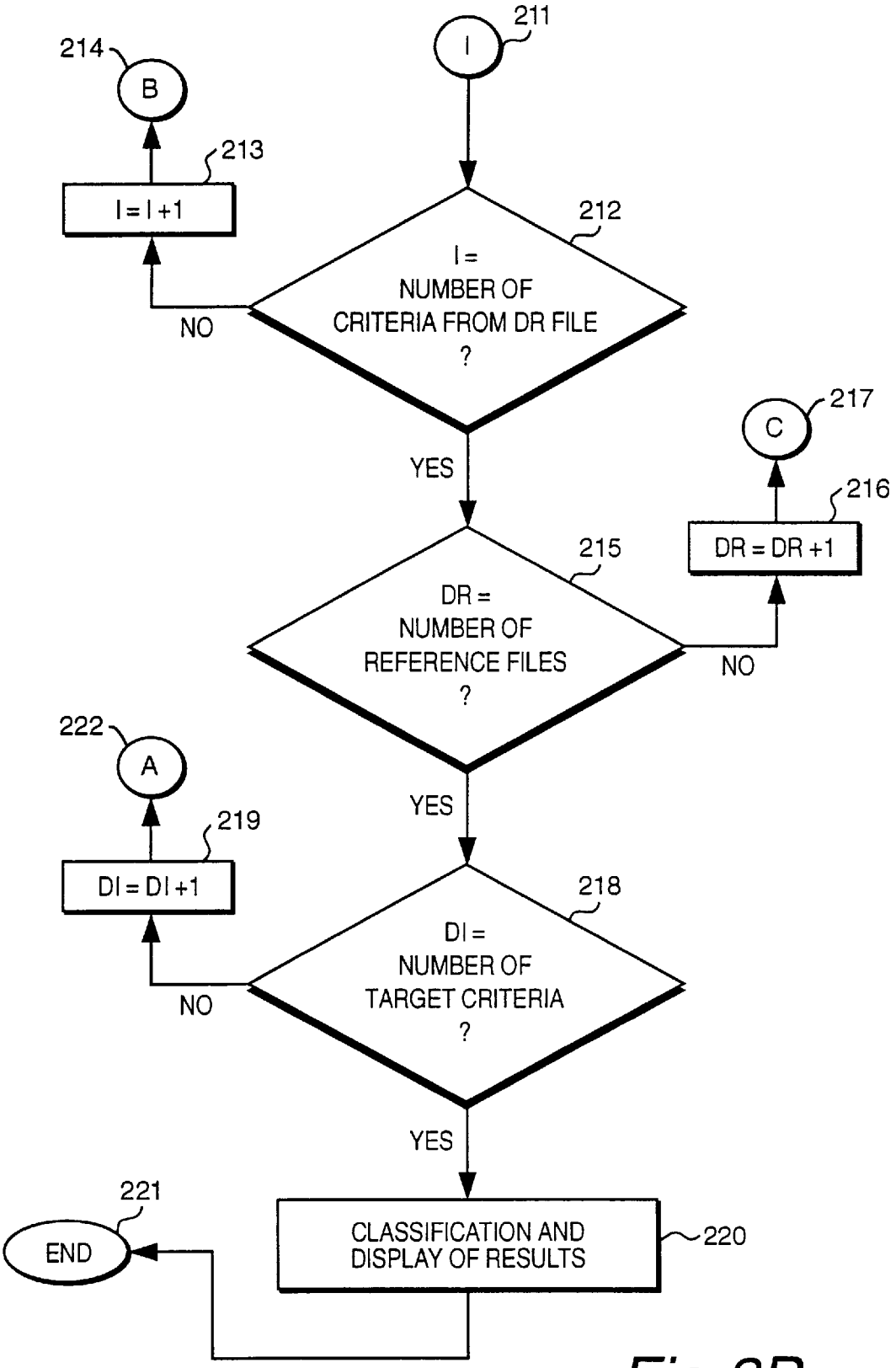

FIG. 2 represents the exploitation system consisting of a data processing system (6) comprising a monitor (10), a central unit (11) provided with an optical disk or CD-ROM reader (14) or with any other mass storage means able to receive transportable carrier (8) containing the data from the database. This system comprises means (13) for inputting commands making it possible to interact with application software (20) for analysis and to search the probability indices between the data corresponding to a target projectile and the data from a reference database. The database is constructed around a table comprising, for each reference to a projectile shell, a number of classification criteria consisting of alphanumeric values stored in this database and organized according to the following criteria represented in the annexed table.

For the shape criterion, its score will be calculated on extraction of the contour followed by the analysis of these geometric criteria and leading to recognition. For the position criteria, the score from each position criterion is calculated as a function of the spatial elongation of the impressions from the target file with respect to that from the reference file. For the texture criterion, its score is expressed based on criteria of co-occurrence and fractal dimension drawn from the analysis of textures. For the criterion of striation, its score is based on the analysis of the mutual distribution of characteristic striations, this analysis of striations being based on searching for corresponding straight lines and the coordinates defining these straight lines if these striations are linear and, if the striations are concentric, on the value of the radius expressing the concentricity of the striations. To extract the criteria of shape and position corresponding to a type of impression, the user, placed in front of his station for exploiting digital data obtained from the image of the camera will display, on screen (16) of his monitor, the view making it possible to see the desired impression and, by interactive means such as mouse (13) associated with interface software that interprets the movements of the mouse and of the cursor on the screen, the user will be able, by selecting from a menu, to initiate the display of a window (17) of variable size formed by a square with dotted lines, whose size the user will make vary so it can come to frame the zone of the image corresponding to the type of impression to which the user desires to apply data processing. Starting from this framed image and from corresponding, stored pixels, the system performs a processing making it possible to extract, on the one hand, the contour corresponding to the flat area of shell (20), shape (22) corresponding to the edges of the primer, and the shape corresponding to impression (21) of the striking pin. These shapes are subjected to data processing, making it possible to determine the position of the centers then, for example, to calculate an index consisting of the ratio between square or rectangular surface (17) and the contour of shell (20). The alphanumeric values for the striations are extracted by data processing to obtain, from the images of striations taken by the camera, the equations of the straight lines representing these scratches. This extraction phase is performed in the acquisition and constitution phase of the database with the help of the equipment of FIG. 1, described above, and of the image processing program described below.

Figure 4:
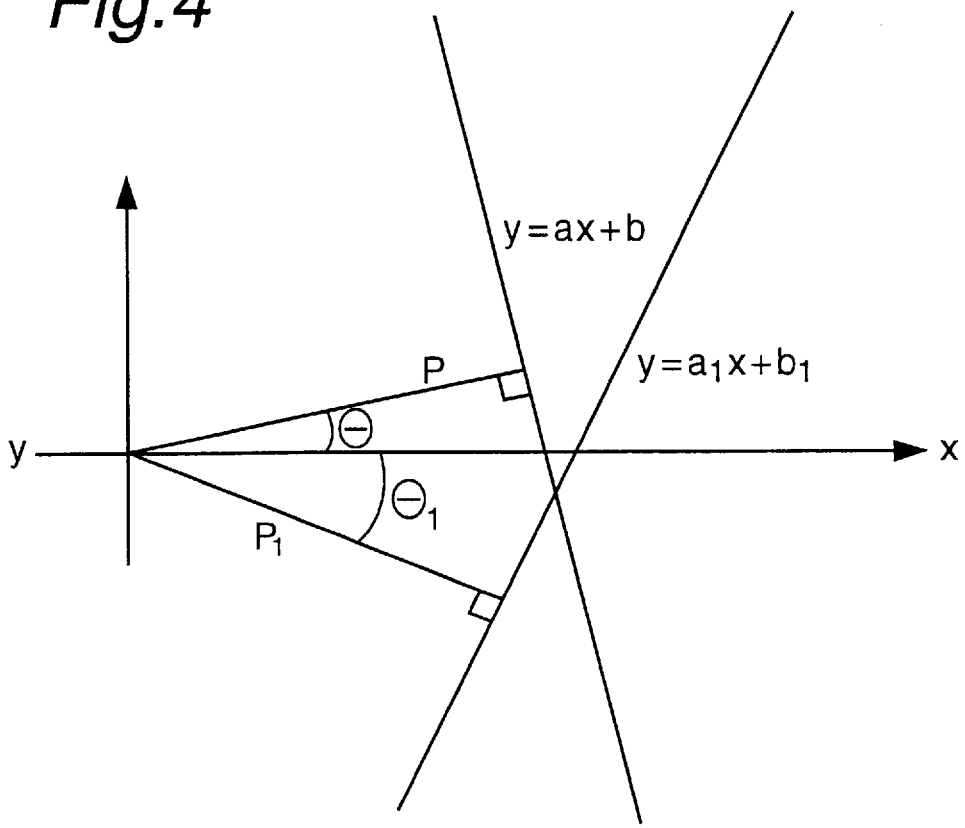
FIG. 4 represents the mathematical principle of the image processing.
Figure 7:
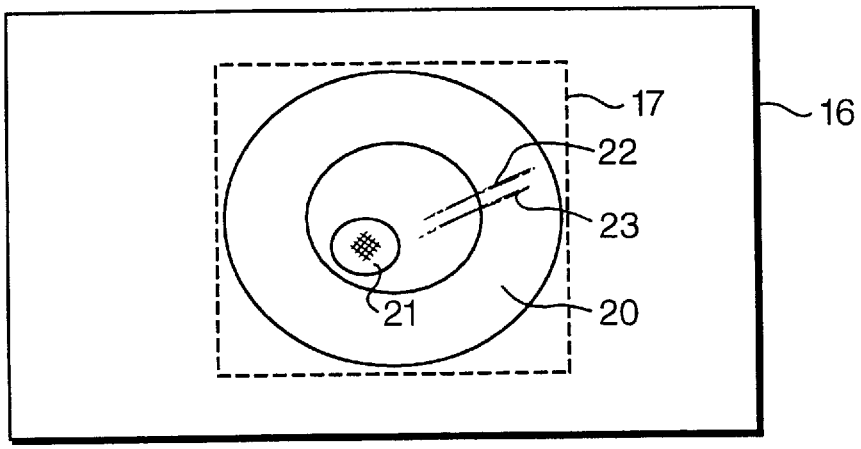
FIG. 7 represents the image of the shell on the installation screen and the means of selecting a zone.

As was seen above, the video acquisition system for digital images provides very high resolution images (1280/1024 pixels) with a sufficient number of gray levels, for example (16, 32, 64). The recording of the image is performed in the memory by three pieces of data, a pair of coordinates in x and y for each pixel, and a gray level associated with each pixel. Once these data are recorded, the method consists in extracting the characteristic striations and in coding them to be able to compare them with the striations from other images of the bullet. With glancing illumination, the striations appear either light (high gray level) or dark (low gray level). During search it is not possible to distinguish the dark striations from the light striations since, as a function of the illumination and of the type of material of the nose of the bullet, even as a function of other mechanical phenomena, the striations will appear sometimes black, sometimes white, the rest of the image having medium intensity gray levels. To extract co-linear or nearly aligned points from among a set of pixels of a stored binary image, the data processing system performs the following processing. This processing is based on the following mathematical property:

To all straight lines of the equation y=ax+b there corresponds another definition in polar coordinates (p, θ) that satisfies the equation (p=x cos θ+y sin θ). To any point xi and yi of the straight line y=ax+b there corresponds thus a pi, θi such that pi=xi cos θi+yi sin θi. With projectiles having been positioned so the striations are practically parallel to axis y of FIG. 1, angle θ of the various striations will vary between −20° and +20°, as represented in FIG. 4. The search program will thus perform, for each pixel xi, yi, a calculation of a number of couples $p_{ij}$, $\theta_j$ with $\theta_j$ between −20° and +20° and varying according to increments, for example, of 2°. For the selected increment value and the variation range of $\theta_j$, thus 20 pairs with value $\theta_{ij}$, $p_j$, associated with each couple xi, yi, are obtained. For another pixel xk, yk, a series of values $p_{kj}$, $\theta_j$ will be obtained and the system defines an accumulation vector based on these lists of values, the accumulation vector being obtained by adding the gray levels of the pixels whose pairs with values $p_{ij}$, $\theta_j$ are identical. In fact, the system associates with each pair xi, yi a plurality of three values $p_{kj}$, $\theta_j$, gl (gray level) then sums for $p_{kj}$, $\theta_j$ identical to the levels of gray and thus is determined a series of accumulation vectors that is in fact a list of three dimensions where the axis of x corresponds to parameters p, the axis of y to parameters θ, the axis of z to the sum of the gray levels of the sinusoidal points that pass through given pair p, θ. The program then detects the local maxima of the levels of gray which, to detect white lines, will consist in determining the local maxima and, to detect dark lines, in searching for the local minima.

To each maximum or minimum there corresponds thus a straight line identified by value p, θ associated with this maximum. Each point p, θ of the sinusoidal equation corresponds to the parametric equation of a straight line. Thus by inverse calculation starting from p, θ, the equation of the straight line can be determined and, starting with this equation of each straight line representative of striations, the coordinates can be determined of a point located at the intersection of this straight line representative of a striation with a straight line that will be, for example, the mid-perpendicular of the screen. This makes it possible to define the striation by a single coordinate point and thus to limit, for each bullet, the number of digital data making it possible to define the various striations.

It is evident that the choice of the dimension of the accumulation vector depends essentially on the type of images analyzed and on the calculation time available. If the straight lines being searched for are oriented in any direction, it will be necessary to take, for parameter θ, a sampling interval between 0° and 180°, with an increment step of 10°, for example.

Thanks to the glancing illumination, the scratches appear on the image of the camera in contrast relative to the surface of the projectile. The operator then completes the data of the database manually by entering the other data such as the caliber, weapon family, type of weapon, etc . . .

This method of extracting digital data from images taken makes it possible, on the one hand, greatly to reduce the storage space necessary and, on the other hand, to obtain a database on a portable object such as a magnetic or electronic carrier that is easily transportable, to be exploited in any place where it is necessary. The exploitation of the database is performed thanks to a data processing system and an application software loaded onto the data processing system intended to exploit, on the one hand, the data from the database, on the other hand, the data furnished by the analysis and extraction of criteria from a file relating to the target projectile. The exploitation software first makes a window (201) appear to the user, making it possible to select, from a menu, the criteria from the target file on which the user wants to work, then to load these criteria from the diskette, CD-ROM, optical disk-type carrier. Then a second window (202) makes it possible for the user, from a menu or by buttons validated by the actions of the mouse, to select criteria from the reference file on which the search is to be performed, these criteria having normally to be the same as those of the target file. At step (203), the system positions a criteria counter (DI) from the target file at 1, then performs, at step (204) the reading of the criterion from the target file having the number (DI). At step (205), the system positions a counter (DR) of the reference file at 1, then at step (206) positions a counter (I) of criteria for the reference file having the number (DR). At step (207), the software examines if the type of the criterion from the target file is identical to the type of the criterion from the reference file. This type is defined by a coded piece of data associated with the digital data of each criterion. In the affirmative case, the system passes to step (208) following the indices calculation. In the negative case, the system jumps to step (211), which makes it possible to go to the criterion of the following reference file. The calculation of the probability index is to be performed at step (208) by a comparison of the digital values for each criterion. Thus for the criterion of scratches, for each scratch of the target projectile it will be examined if the position of these scratches corresponds to the position of scratches of the reference file. If the position of all the scratches of the target projectile correspond to the positions of scratches of the reference file, it is examined at step (209) if there is a need to apply a filter in determining, at step (209), the type of the criterion and if criteria of scratches or overlapping scratches are involved. The system applies a filter if the ratio of the number of scratches from the reference file identical to the scratches of the target file to the total number of scratches of the reference file is greater than 0.6. If so there is applied, to the result of the probability analysis that corresponds to 90 or 100%, for example a reducing coefficient to bring it to a value that is closer to reality, taking into account the fact that what is being looked at is the equality between the target file and the reference file and not between the reference file and the target file. Then the program continues with a test (212) to determine if counter (I) of reference file criteria is equal to the total number of criteria from the reference files, if this test is negative, at step (213), this counter (I) is advanced and the program rebranches to level (214) before the test between the type of criterion from the reference file and the type of criterion from the target file. If counter (I) is equal to the total number of criteria, the program passes to following step (215), which consists of a test to determine if counter (DR) of the number of reference files is equal to the total number of reference files. If, at step (215), the answer is no, counter (DR) of the reference file is advanced to step (216) and the program rebranches between steps (205), initializing the reference file counter, and step (206), initializing the criteria counter for the reference files, If the answer is yes at step (215) for the test of the number of reference files examined, the program goes to step (218), consisting of a test of the number (DI) of target criteria to examine if this number is equal to the total number of criteria. If not, the program advances counter (DI) of the number of target criteria (219) and rebranches between step (203) of initializing the counter of the target file criteria and step (204) of reading the criterion of the target file. If test (218) is positive, the program continues to step (220) by classifying and displaying the results obtained. This classification makes it possible to determine, in the database, a certain number of projectiles whose characteristic most approximate the criteria retained. This software thus makes it possible for the user to work on comparison criteria and, according to the files, more wisely to select the criteria that will make it possible to arrive at a conclusion. Such software thus makes it possible for an investigator, starting with three portable elements, one comprising the application software, the other the database and the third the data from the target projectile file, to progress in an investigation.

Figure 5:
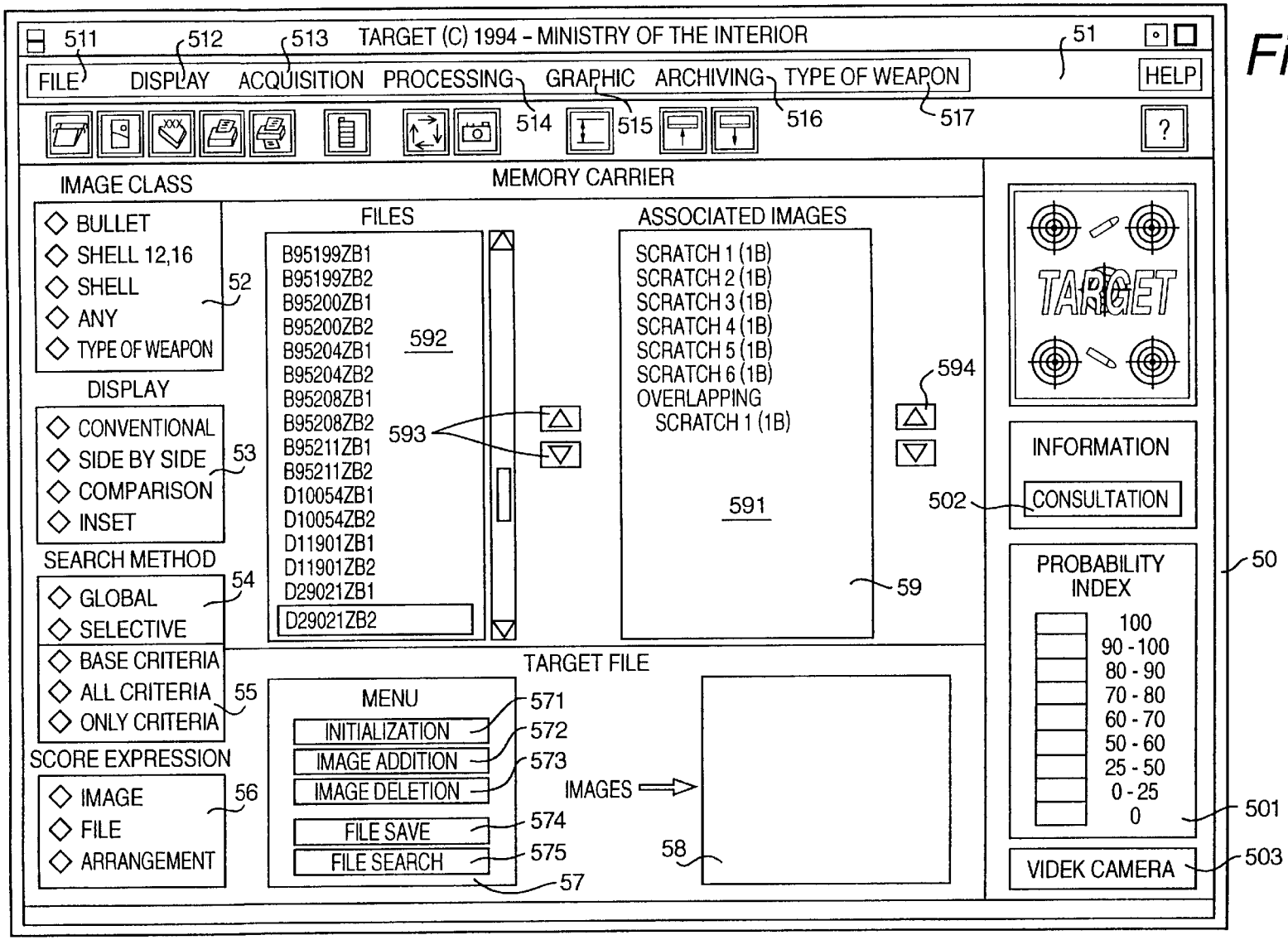
FIG. 5 represents the general window of the application software.
Figure 6:
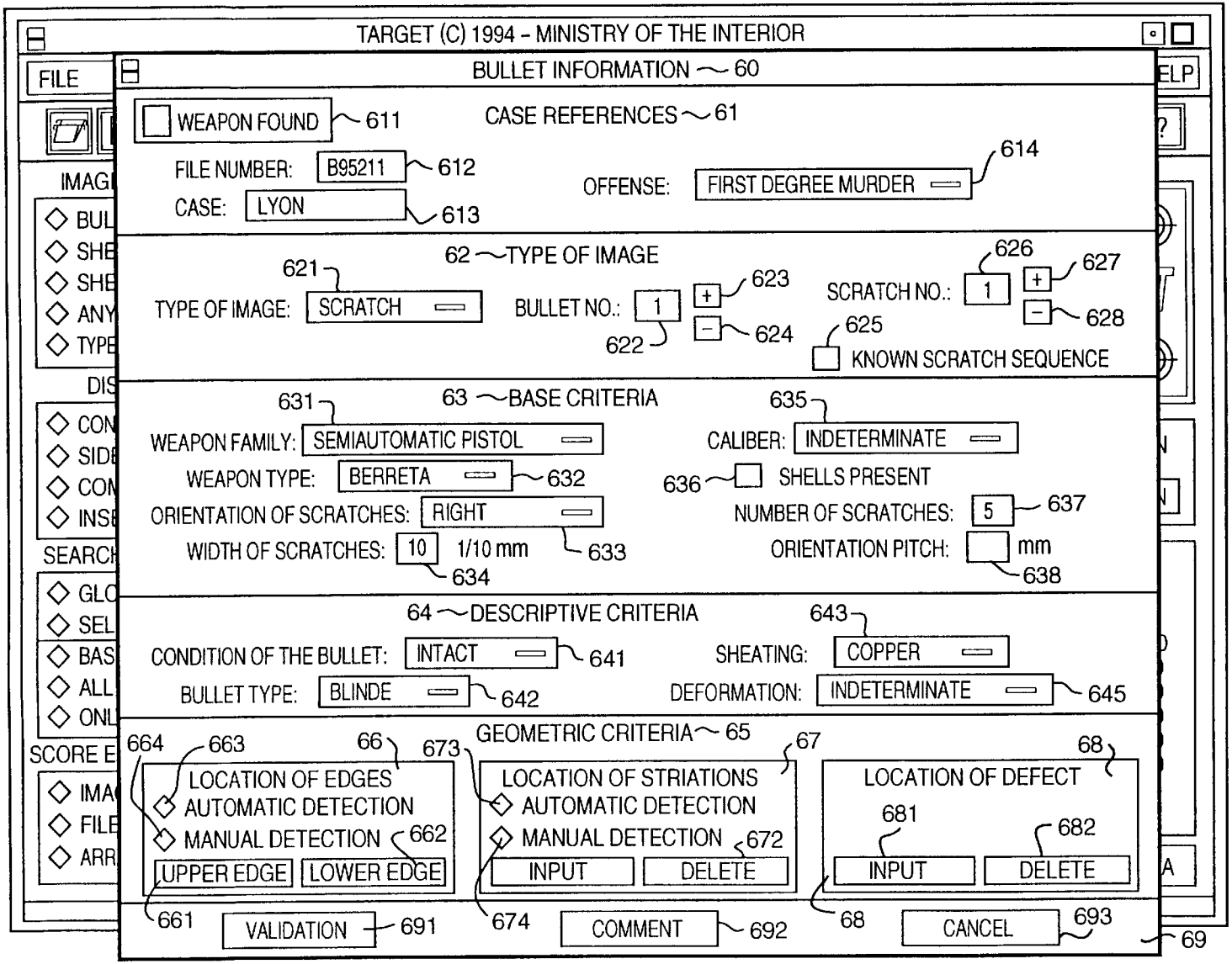
FIG. 6 represents the display window of the selection criteria for search.

The application software comprises an interface program that makes it possible to display the windows of FIGS. 5 and 6 and to manage keyboard or mouse actions as a function of the mouse button or of the depressed keyboard key and of the position of the cursor represented on the screen to initiate the operations corresponding to the displayed buttons or functions. Thus general window (50) comprises a bar menu (51) from which the operator can select file menu (511), display menu (512), acquisition menu (513), processing menu (514), graphics menu (515), archival menu (516), and weapons type menu (517). A subwindow that makes it possible to select the operations or functions to be performed is associated with each of these menus. Window (50) also comprises a first group or box of buttons (52) comprising a button bullet, a button shell of caliber 12, 16, a button shell, a button for anything, a button weapons type. The operator can also select, from a group of buttons (53), the type of display from among the following: conventional, side by side, comparison, inset. Finally, the operator can select the type of search from groups of buttons (54, 55) by selecting between a global search and a selective search and, in this type of search, select the search conditions, for example on the base criteria, on all the criteria or only on certain criteria. Finally, a group of buttons (56) makes it possible to choose the expression mode of the score, by an image, a file or an arrangement. A window (59) makes it possible to display, in a scrolling list (592), the references of available files and to control the scrolling of this list by advancement buttons (593) of the list so as to highlight the desired file. A second scrolling list (591) makes it possible to display the images associated with a highlighted file and, from these associated images, to select the desired image(s) by choosing for example scratch (3) and overlapping scratch (1). Arrows (594) for controlling the scrolling of menu list (591) make it possible to highlight an associated image that is desired to be selected. Finally, main window (50) also comprises, for a target file, a menu (57) that makes it possible to choose the actions to be performed from among the following: initialization (571), image addition (572), image deletion (573), file saving (574), search file (575) and, next to this menu (57) there is a window (58) in which an image stored in memory can be made to appear.

This main window (50) also comprises an information button (502) and a graphics window (501) making it possible to display, according to a color code, the calculated probability index corresponding to the comparison between a target file and a selected file. Finally, a button (503) makes it possible to go to a menu that controls the camera.

When information button (502) is clicked, the software makes the window of FIG. 6 appear, which is divided into nine successive zones (61 to 69). A first zone (61) corresponds to case references and comprises a button (611) that makes it possible to indicate if a recovered weapon is involved and to document, in an alphanumeric text zone (612), the file number, in another zone (613), the case name, and in a zone (614), the type of violation. A second zone (62) relates to the type of image and makes it possible, by a button (621), to select the type of image from among the various types: scratches, defects, etc., a text zone makes it possible to display the bullet number and addition buttons (623) and subtraction buttons (624) make it possible to increase or decrease the bullet number. A zone (626) comprising same addition (627) and subtraction (628) buttons makes it possible to indicate the number of scratches and a button (625) makes it possible to indicate if the order of scratches is known. A third zone corresponds to base criteria and makes it possible to select, by a scrolling list (631), the family of weapons from among the families cited above, a scrolling list (632) makes it possible to select the weapons type from a recorded list, a scrolling list (633) makes it possible to select the orientation of the scratches to the right or to the left, a scrolling list (635) makes it possible to select the caliber, a button (634) makes it possible to choose the width of the scratches, a button (636) makes it possible to determine if a shell is present, a button (637) makes it possible to indicate the number of scratches and a button (638) makes it possible to enter the orientation pitch in millimeters. A fourth zone (64) makes it possible to choose the descriptive criteria from four scrolling lists, a first (641) describing the state of the bullet (intact, for example), a second (642) describing the bullet type (steel-clad, for example), a third (643) describing the sheathing (copper-plated, for example), a fourth (645) describing the deformation (indeterminate). A fifth zone makes it possible to select the geometric criteria by three subzones (66, 67, 68), a first subzone for determining the location of the edges makes it possible, by a button (663), to initiate automatic detection or, by a button (664), to go to manual detection, these two buttons operating on the toggle principle, a third button (661) makes it possible to determine if it is the upper edge and a fourth button to determine if the lower edge is involved. Second subzone (67) makes it possible to choose the striation location criteria by a button (673) for automatic detection and by a button (674) for manual detection. This zone also comprises a button (671) for input and a button (672) for deletion. Finally, third subzone (68) makes it possible to locate the defects and comprises an input button (681), a deletion button (682). Last zone (69) of the window comprises three buttons, validation (691), commentary (692), cancellation (693), making it possible either to validate, input commentary, or cancel the selection made by the operator concerning the bullet information criteria.

Figure 8:
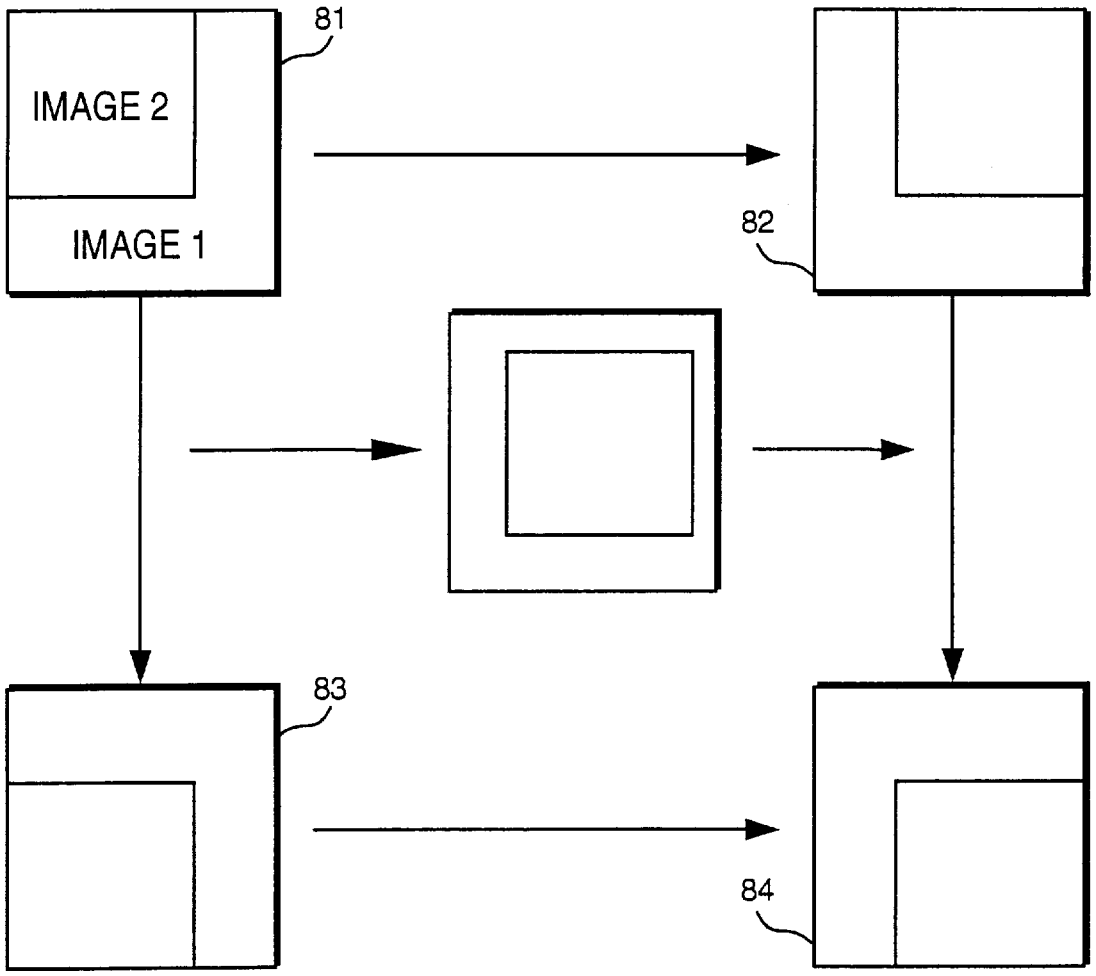
FIG. 8 represents the algorithmic principle of comparison according to the correlation criteria.

It is possible to add, besides third subzone (68), other subzones, not represented, that would make it possible to call up other shell analysis criteria such as the criterion of correlation. This criterion of correlation uses the principle of statistical correlation that makes it possible, when two statistical variables x and y are available that have the same number of elements $x_1$ and $y_i$, i going from 1 to n, to calculate a correlation coefficient r between these two variables, given by the following formulas: $Sx=\Sigma xi$; $Sy=\Sigma Yi$; $Sx^2=\Sigma(Xi)^2$; $Sy^2=\Sigma(Yi)^2$; $Sxy=\Sigma Xi*Yi$; $SXX=Sx^2-(Sx)^2/n$; $SYY=Sy^2-(Sy)^2/n$; $SXY=Sxy-(Sx*Sy)/n$; correlation coefficient r is given by formula :$r=SXY/\sqrt{SXX*SYY}$. This correlation coefficient r is used to compare either two shell images with each other, or shapes extracted from images. In the case of two images, statistical variable X corresponds to the pixel of image number 1 and statistical variable Y corresponds to the pixel of image number 2. In the case of two shapes, variable X corresponds to contour points of shape number 1 extracted from an image and variable Y corresponds to contour points from shape number 2 extracted from the second image. The comparison algorithm using the correlation criterion is based on the principle that image number 1 is certainly different in size from image number 2, as represented in FIG. 8. In the case represented by reference (81), the part of image number 2 will be compared with the part of image number 1 that is superimposed on image number 2. Correlation criterion r is calculate between pixels $x_1$ of the part of image number 1 that is superimposed on number 2 and criteria $Y_1$ of image number 2. Then a horizontal shift is made of one pixel in the selection of pixels from image number 1 that are correlated with the pixels of image number 2 and the program calculates the new correlation criterion. Then the program continues the horizontal shifts until the pixels of image number 1 correlated with image number 2 are superimposed as in reference example (82) on image number 2 in FIG. 8 and the program calculates the correlation criterion at each shift. The algorithm then continues by applying a vertical shift of one pixel and by starting again from the position where the zone of selected image number 1 is located the most to the left, as represented by reference (81), with a vertical shift of one pixel. The program will process, by a succession of horizontal and vertical shifts, the groups of pixels of the zones from image number 1 corresponding to the surfaces of image number 2 and will calculate the correlation coefficients between the various possible arrangements. After a certain number of vertical shifts, one returns to the situation represented by reference (83). Then a succession of horizontal shifts is again performed to return to the situation represented by reference (84). For each situation resulting from a shift, the system also calculates the correlation coefficient. Then the program compares the series of correlation coefficients obtained after the various successive shifts to determine the maximum correlation coefficient that corresponds to the best score between the two images.

When this comparison algorithm is used between two shapes, at the beginning an expansion sequence is used between the images of the two shapes and a comparison sequence with the rotation angles that are advanced by three degrees each time. These rotations and expansions are combined with the successive horizontal and vertical shifts of the images to obtain several series of correlation coefficients among which the maximum correlation coefficient is sought. This makes it possible automatically to determine the image or the shapes of shells corresponding to the target shell.

It will be understood that what has been achieved is a process for comparing projectiles that makes it possible to have greater flexibility in using comparison criteria requiring a less sophisticated, easily usable data processing system no matter where it is used.

Other modifications within the scope of one skilled in the art are also part of the spirit of the invention.

We claim:

1. Process for comparing projectile shells characterized in that the process comprises:

a step of constituting and storing information concerning different existing projectiles in a memory of a database, containing, for each referenced projectile, a large amount of digital data, each piece of data corresponding to a different criterion associated with an impression on the projectile;

a step of taking a determined number of images of a target projectile and processing these images by a data processing system to extract the digital data, each datum corresponding to one of the criteria of the database;

a step of processing and extracting the digital data comprising a step of selection on a display means by interactive means from an image zone displayed on the display means and including the impression corresponding to a criterion, conversion of the selected zone of the image into a digitized representation of the image, then processing the digitized representation to extract the parameters that correspond to a given criterion;

a step of comparing each of the pieces of data of a target projectile with the data from each referenced projectile for the same criteria.

2. Process of comparing projectile shells according to claim 1, wherein the extraction and processing method varies as a function of the type of impression and of the associated criterion.

3. Process of comparing projectile shells according to claim 1, wherein each type of impression has a defined number of criteria selected from among the criteria of shape, position, texture, striation.

4. Process of comparing projectile shells according to claim 3, wherein, when the type of impression is the percussion zone, the system calculates the center of the shape of the zone, then calculates an index that is the ratio of the selected zone to the surface of the impression.

5. Process of comparing projectile shells according to claim 1, wherein the user has means making it possible to determine the criteria taken into account for the comparison, said means consisting of a list of criteria than can be displayed on display means and by actions, such as clicks, that can be selected and validated by the user thanks to mouse-type input means.

6. Process of comparing projectile shells according to claim 5, wherein the process performs a comparison according to the criterion of the caliber of the projectile shell.

7. Process of comparing projectile shells according to claim 5, wherein the process performs a comparison of the data on criteria corresponding to the impression of the stop.

8. Process of comparing projectile shells according to claim 5, wherein the process performs a comparison of the data on criteria corresponding to the impression of the lack of primer.

9. Process of comparing projectile shells according to claim 5, wherein the process performs a comparison of the data on criteria corresponding to the impression of the ejector.

10. Process of comparing projectile shells according to claim 5, wherein the process performs a comparison of the data on criteria corresponding to the impression of the extractor.

11. Process of comparing projectile shells according to claim 5, wherein the process performs a comparison of the data on criteria corresponding to the impression of the loading indicator.

12. Process of comparing projectile shells according to claim 5, wherein the process performs a comparison of the data on criteria corresponding to the impression of the feed mechanism mark.

13. Process of comparing projectile shells according to claim 5, wherein the process performs a comparison of the data on criteria corresponding to the impression of the passage of the extractor.

14. Process of comparing projectile shells according to claim 5, wherein the process performs a comparison of the data on criteria corresponding to the impression of the passage of the ejector.

15. Process of comparing projectile shells according to claim 5, wherein the process performs a comparison of the data on criteria corresponding to the percussion impression.

16. Process of comparing projectile shells according to claim 5, wherein the process performs a comparison of the data on criteria corresponding to the impression of primer striations and of the flat area left by the bolt mechanism during firing.

17. Process for comparing projectile shells according to claim 16, wherein the comparison of the target data with the reference data according to the criterion of striations is performed by counting the number of scratches on the target projectile located at the same spot as the scratches on the reference projectile, then by applying a filtering coefficient to the result if the ratio between the number of scratches of the reference file, having been counted, and the total number of scratches of the reference file is greater than 0.6.

18. Device characterized in that it comprises a presentation table of the specimen projectile provided with glancing illumination parallel to the support of the projectile, a support that carries a digital-type camera with a wide field in a direction perpendicular to the support plane of the camera having a resolution of 1280×1024 pixels;

a device for analyzing digital data representing the acquired image and making it possible to extract, for a given specimen, the digital value representing each criterion associated with a type of impression different from a scratch, interactive means making it possible for the user to complete the other criteria constituting the data from the database such as data relating to caliber, defects;

means for storing these data on a transportable or transferable physical carrier.

19. Device according to claim 18, wherein the interactive means comprise application software making it possible to display, on a monitor, a window comprising a number of text zones each corresponding to a criterion and intended to receive and accept only digital data with, for each text zone, the designation of the criterion involved next to the text zone.

20. Device according to claim 18, wherein it is used to extract data concerning a target projectile and exploit these data in a data processing system provided with application software making it possible to select, from the database, criteria from the target file and, from the database of the data processing system, the same criteria for the reference files, then to perform, for each criterion, a counting of identical data to determine a probability index.

21. Device according to claim 20, wherein the reference database and the digital values of the criteria from the target file are stored on a transportable physical carrier.

* * * * *